US012041985B2

(12) United States Patent
Uritsky

(10) Patent No.: US 12,041,985 B2
(45) Date of Patent: Jul. 23, 2024

(54) GROIN PROTECTOR WITH OPENING HATCH

(71) Applicant: Dimitry Uritsky, Vancouver (CA)

(72) Inventor: Dimitry Uritsky, Vancouver (CA)

( * ) Notice: Subject to any disclaimer, the term of this patent is extended or adjusted under 35 U.S.C. 154(b) by 0 days.

(21) Appl. No.: 17/668,604

(22) Filed: Feb. 10, 2022

(65) Prior Publication Data

US 2023/0248088 A1 Aug. 10, 2023

(51) Int. Cl.
*A41D 13/05* (2006.01)
*A63B 71/12* (2006.01)

(52) U.S. Cl.
CPC ..... *A41D 13/0568* (2013.01); *A41D 13/0525* (2013.01); *A63B 71/1216* (2013.01)

(58) Field of Classification Search
CPC ..... A63B 71/1216; A41D 13/0525; A41D 13/0568; A41D 1/065; A41F 5/40
USPC ..... 2/466, 455
See application file for complete search history.

(56) References Cited

U.S. PATENT DOCUMENTS 3,176,686 A * 4/1965 Barnes ..... A63B 71/12 602/73
3,788,314 A * 1/1974 Noreen ..... A63B 71/1216 602/73
4,014,044 A * 3/1977 Figueroa ..... A41B 9/02 2/466
4,389,733 A * 6/1983 Boykins, Jr. ..... A41D 1/08 2/466
4,961,234 A * 10/1990 Leibman ..... A41D 1/06 2/408
5,484,366 A * 1/1996 Wilkinson ..... A63B 21/0004 607/108
5,819,323 A * 10/1998 Edenfield ..... A41B 9/02 2/403
5,920,914 A * 7/1999 Dempsey ..... A41B 9/02 2/403
5,984,910 A * 11/1999 Berke ..... A41B 9/023 128/854
7,178,176 B1 * 2/2007 S-Cronenbold ..... A41D 1/088 2/403
7,716,755 B1 * 5/2010 Wiens ..... A41D 1/088 2/466
D660,551 S * 5/2012 Steele ..... D2/712
8,555,422 B2 * 10/2013 Steele ..... A41B 9/023 2/403
10,285,460 B2 * 5/2019 Gawrys ..... A41B 9/12
2015/0230523 A1 * 8/2015 Stevenson ..... A41D 13/012 2/79
2016/0295930 A1 * 10/2016 Stevenson ..... A41D 13/02

* cited by examiner

*Primary Examiner* — Katharine G Kane
(74) *Attorney, Agent, or Firm* — CAPEHART LAW FIRM

(57) ABSTRACT

A device for protecting a groin area of a user includes a main body having an opening therein, a cover for selectively covering the opening, and a fastener for attaching the device over the groin area of the user. The device allows the user to urinate (through the opening) without having to remove the device and provides protection after injury, operation and/or in any other circumstance in which the user requires groin protection (such as during sports).

16 Claims, 13 Drawing Sheets

GROIN PROTECTOR WITH OPENING HATCH

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of groin protectors of existing art and more specifically relates to a groin protector with an opening for providing urine relief.

RELATED ART

Groin protectors have been known in the art for use in a variety of applications. Particularly, groin cups and other guards are used for protecting the groin area during sporting activities. Further, groin protectors can be worn during everyday activities to protect the groin whilst recovering; for example, from an injury or operation. Groin protectors typically include a rigid body configured to withstand an impact and include means for attaching the groin protector to the user. However, there exists disadvantages with the current groin protectors in the art. Most notably, as groin protectors are attached to the groin area of the user, to use the bathroom, removal of the groin protector is required. This can be time consuming and awkward. This is particularly true in circumstances where the groin protector is worn for a large part of the user's day. As such, a suitable solution is desired.

SUMMARY OF THE INVENTION

In view of the foregoing disadvantages inherent in the known groin protection art, the present disclosure provides a novel groin protector with opening hatch. The general purpose of the present disclosure, which will be described subsequently in greater detail, is to provide a device configured for wear about a groin area of a user to protect the groin area and including an opening that is selectively uncovered. The opening allows the user to urinate therethrough without having to remove the device.

A device for protecting a groin area of a user is disclosed herein. The device may include a main body, a cover, and a fastener. The main body may include an opening therein, an outer surface, and an inner surface. The inner surface may be configured for encompassing the groin area of the user. The cover may be attached to the main body and configured to selectively cover and uncover the opening, thereby moving the opening between an open position and a closed position. The fastener may be attached to the main body and configured to secure the device to the user. The opening may be located about a genital area of the user when the device is secured to the user, and the open position may enable the user to urinate through the opening.

According to another embodiment, a method of using a device for protecting a groin area of a user is also disclosed herein. The method may include providing the device as above; securing the device to the user via the fastener; arranging the main body such that the inner surface encompasses the groin area of the user; selectively moving the cover to uncover the opening, thereby placing the opening in the open position and enabling the user to urinate therethrough; and moving the cover to cover the opening, thereby placing the opening in the closed position.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a groin protector with opening hatch, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to a groin protector and more particularly to a groin protector with opening hatch. Generally, the groin protector with opening hatch may include a groin protecting cup that includes an opening which allows the user to urinate therethrough without having to remove the groin protecting cup. The groin protector with opening hatch may preferably be comfortable and easy to wear and use. Further, the groin protector may provide all day protection of a groin area of the user after an injury, operation, and/or any other circumstances where the user desires to keep the groin area protected.

Figure 1:
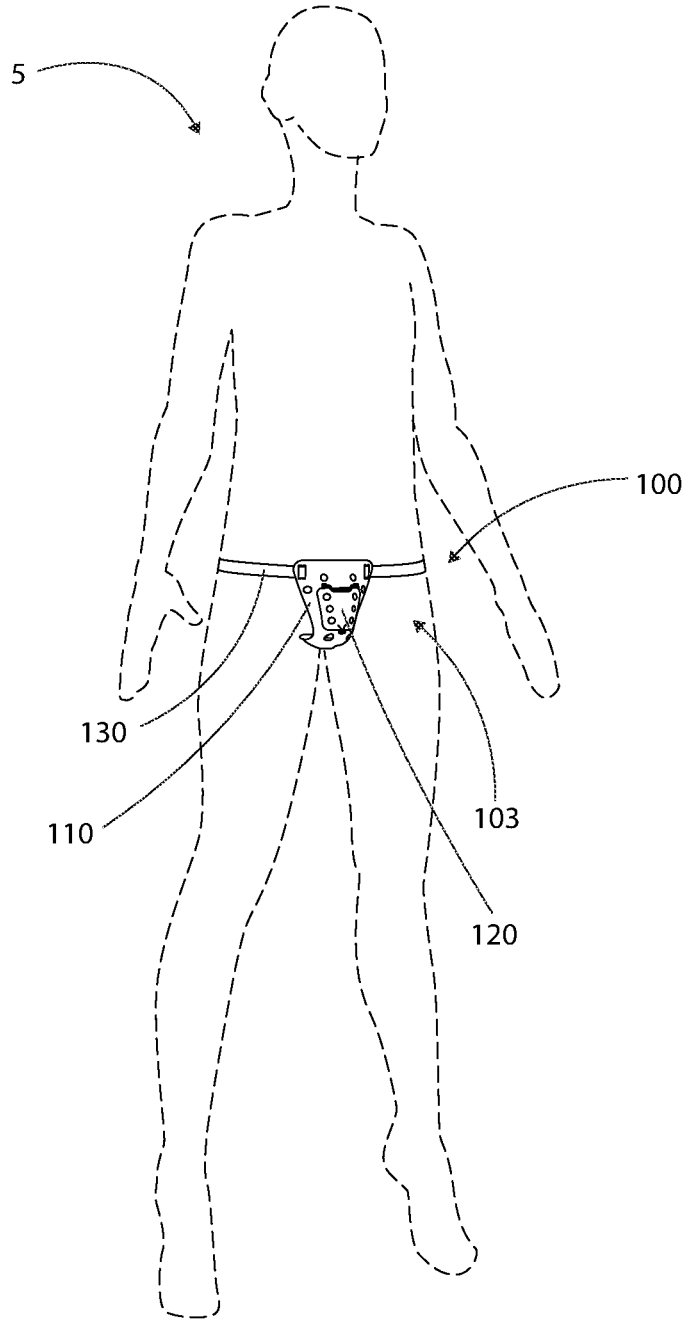
FIG. 1 is a perspective view of a device being used to protect a groin area of a user, an opening of the device being in a closed position, according to an embodiment of the disclosure.
Figure 2:
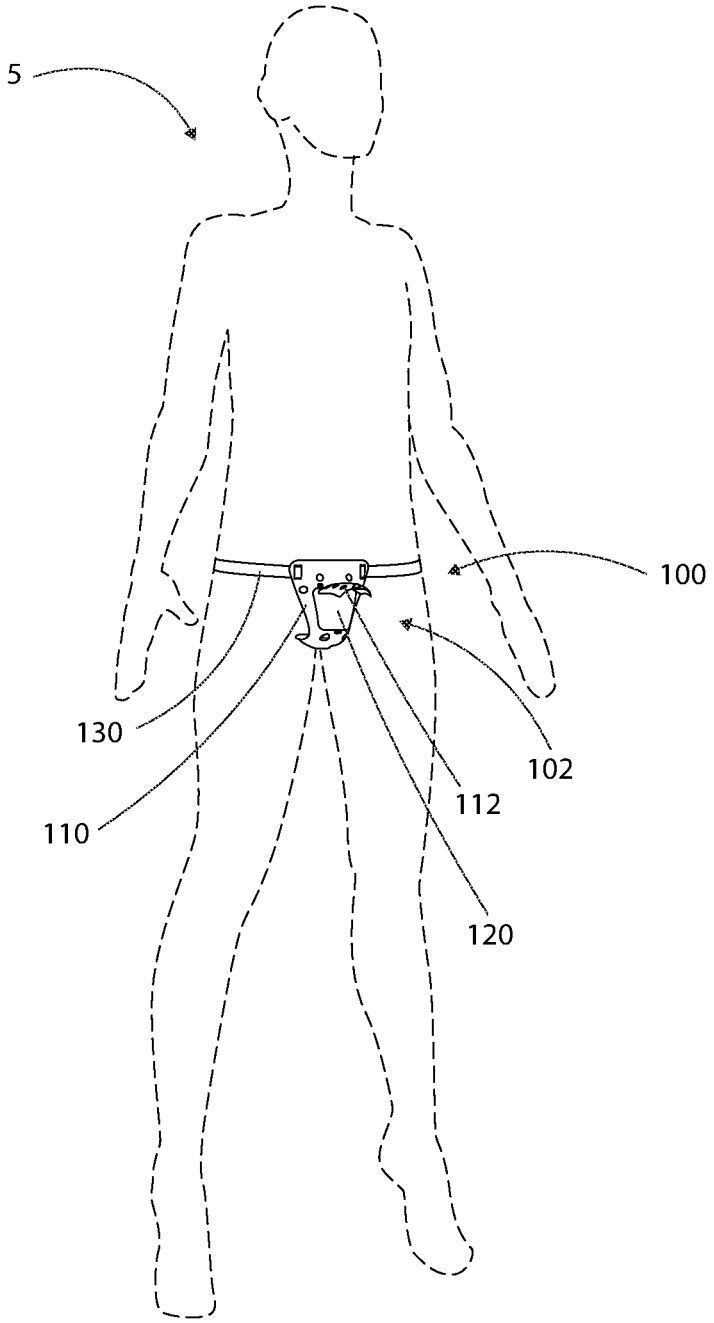
FIG. 2 is a perspective view of the device being used to protect the groin area of the user, the opening of the device being in an open position, according to an embodiment of the disclosure.

Referring now more specifically to the drawings by numerals of reference, there is shown in FIGS. 1-12, various views of a device 100. As shown, the device 100 may include a main body 110, a cover 120 and a fastener 130. As shown in FIGS. 1-2, the device 100 may be used for protecting a groin area of a user 5. Particularly, the device 100 may be worn by a male user. The device 100 may protect the groin area after injury, operation, and/or any other circumstances in which the user 5 desires to protect their groin area (such as during sports). It should be appreciated that the device 100 is not limited to male users and may also be used by female users.

Figure 3:
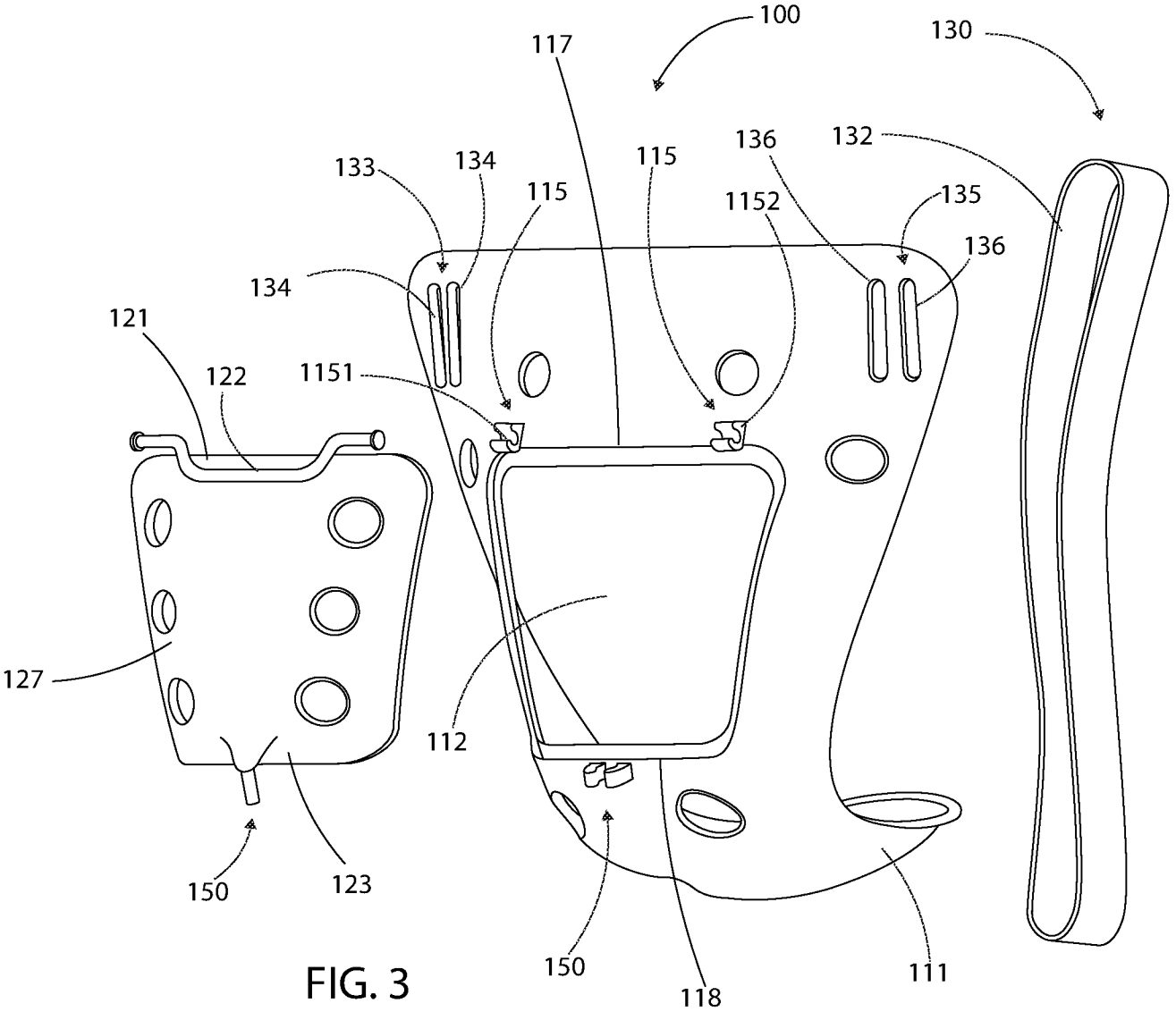
FIG. 3 is an exploded view of the device and illustrating a main body, a cover and a fastener, according to an embodiment of the present disclosure.
Figure 4:
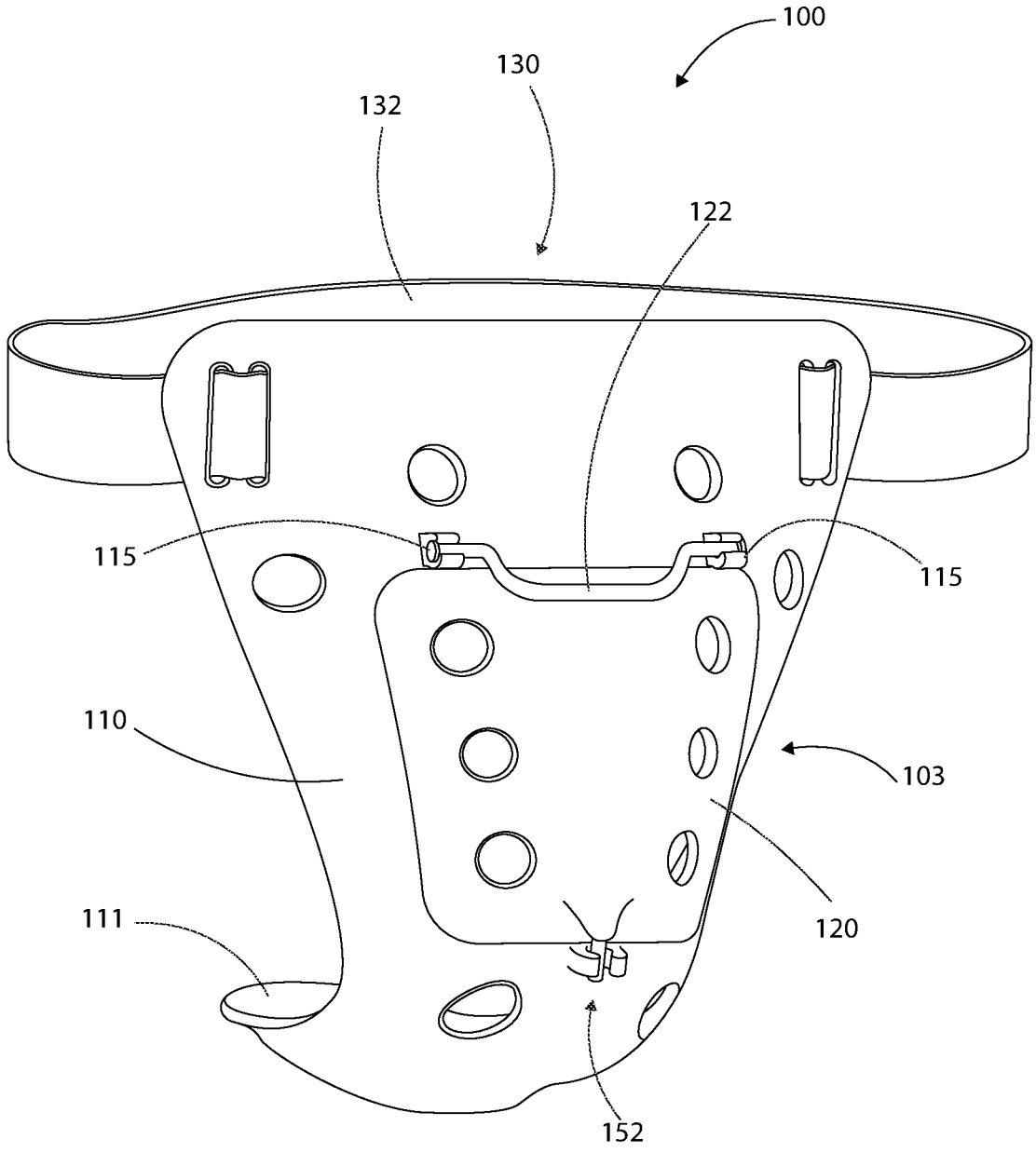
FIG. 4 is a front perspective view of the device in the closed position, according to an embodiment of the present disclosure.
Figure 5:
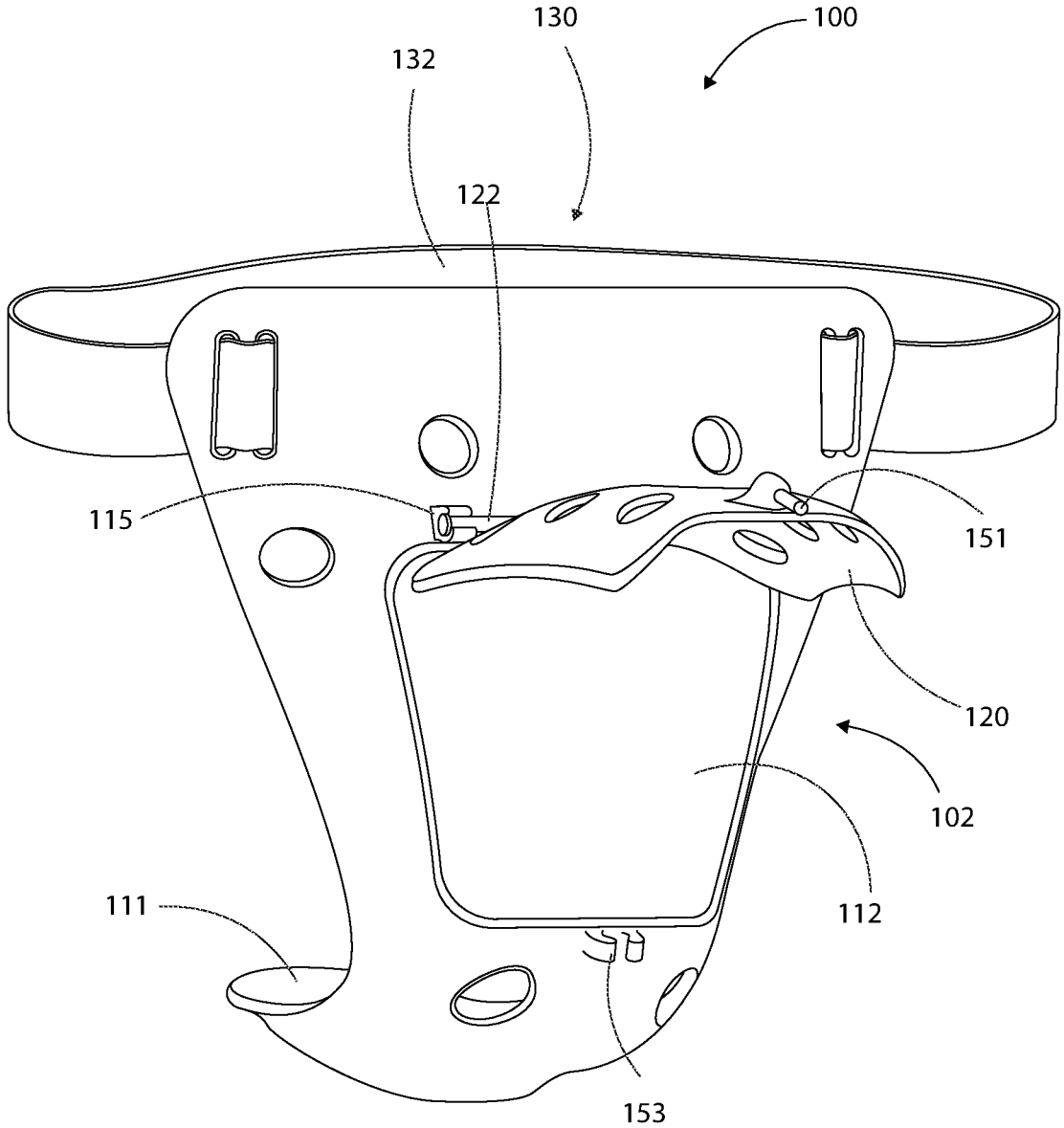
FIG. 5 is a front perspective view of the device in the open position, according to an embodiment of the present disclosure.

As shown in FIGS. 1-2, the fastener 130 may be attached to the main body 110 and configured to secure the device 100 to the user 5. Particularly, the fastener 130 may be include at least one strap 132 which may be configured to fasten around a waist area of the user 5. As shown in FIGS. 3-5, and particularly in FIG. 3, the at least one strap 132 may be one strap formed as a continuous loop. However, it should be appreciated that there may be one or more straps, the strap(s) not be formed in a continuous loop, the strap(s) may include fasteners, etc. Further, it should be appreciated that the fastener 130 is not limited to strap(s). For example, adhesives, suction, etc. may be used.

Figure 6:
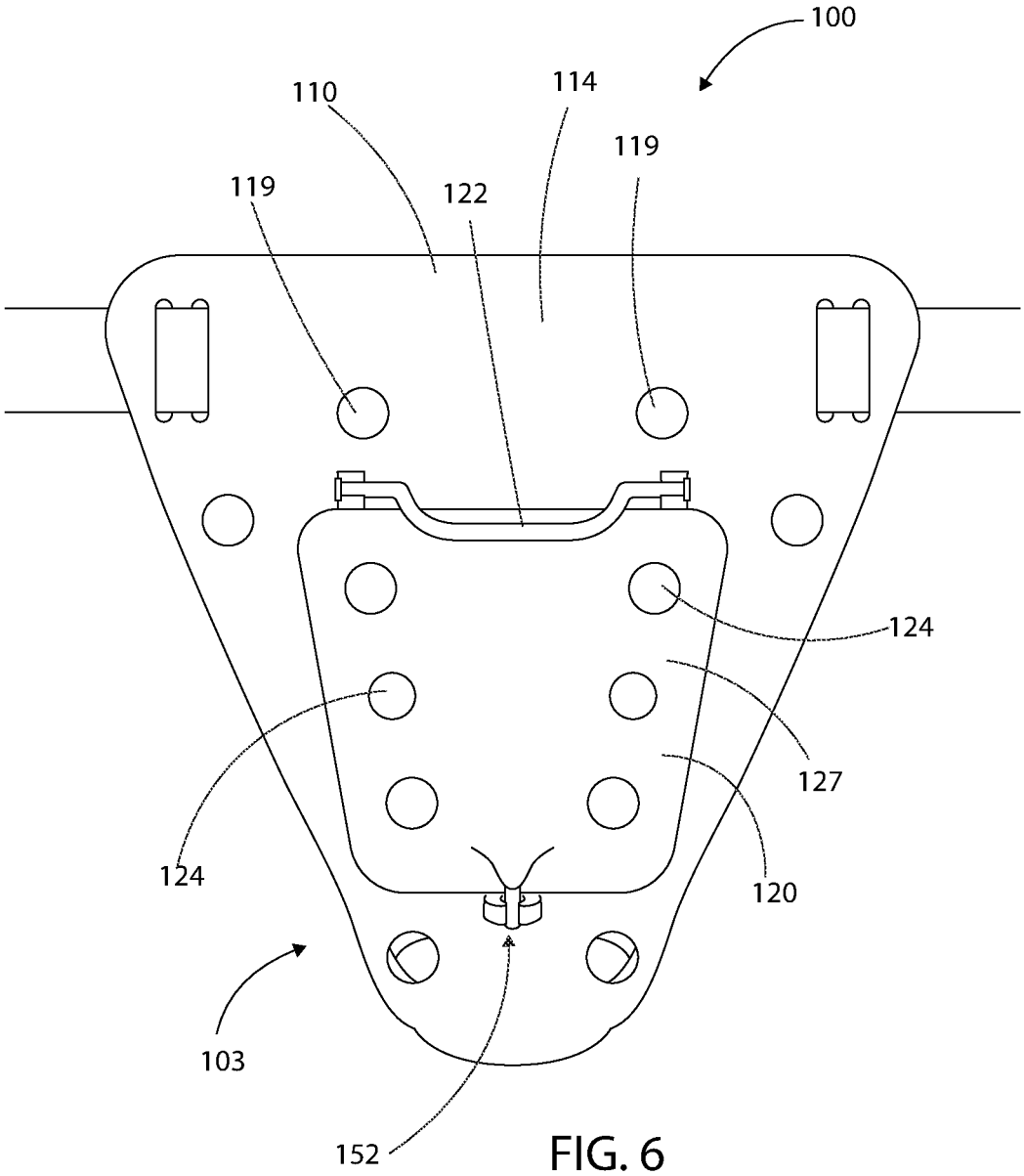
FIG. 6 is a front view of the device in the closed position, according to an embodiment of the present disclosure.
Figure 7:
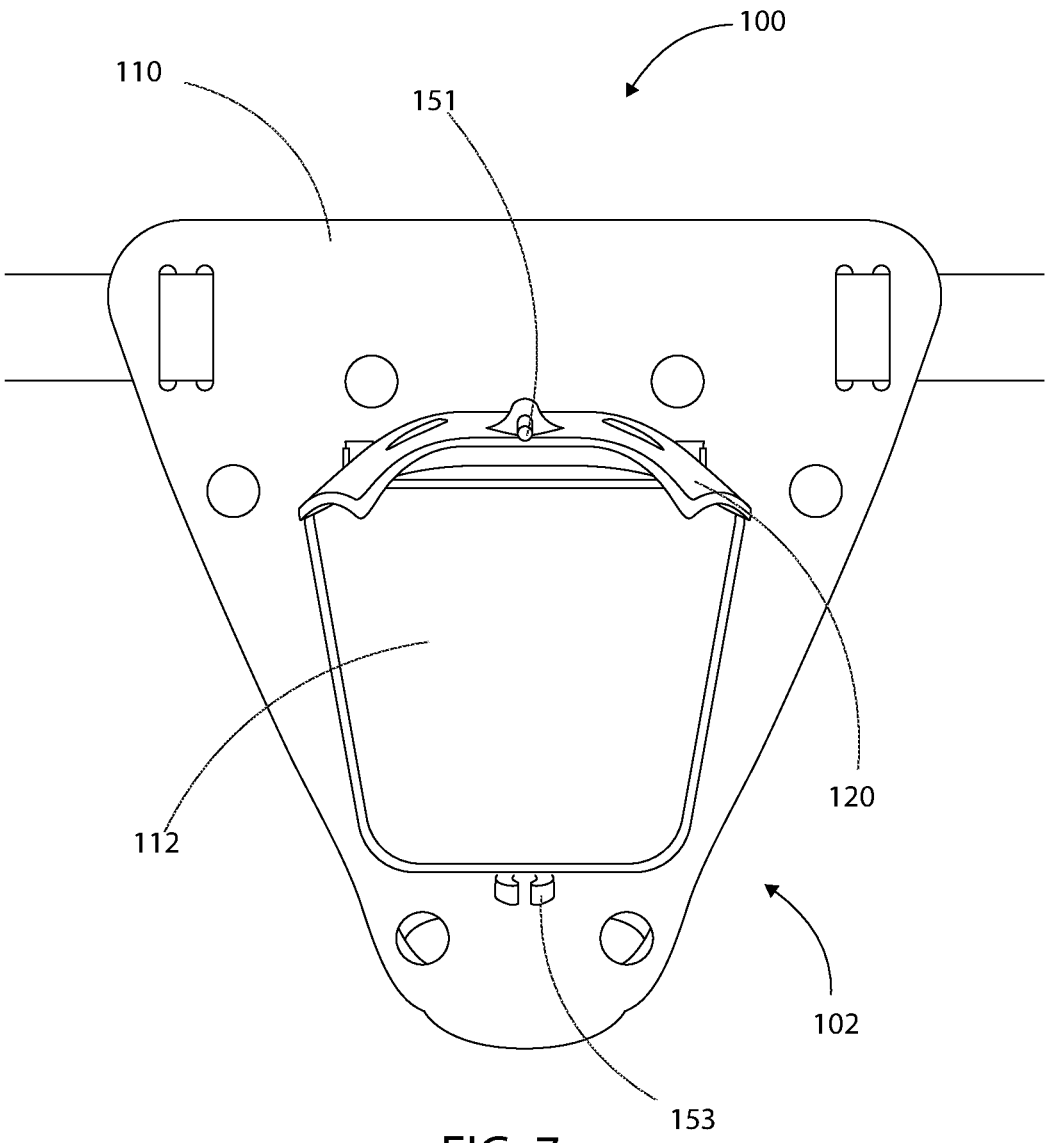
FIG. 7 is a front view of the device in the open position, according to an embodiment of the present disclosure.
Figure 8:
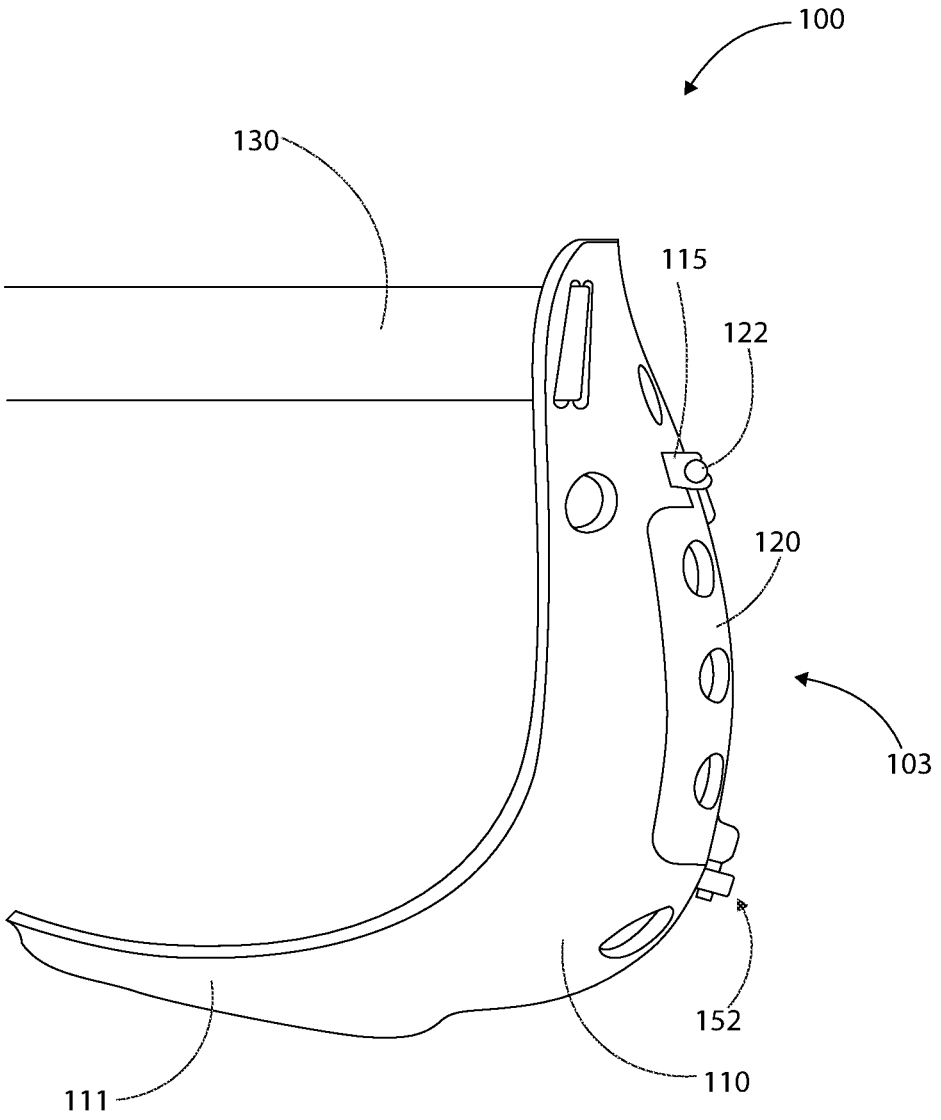
FIG. 8 is a side view of the device in the closed position, according to an embodiment of the present disclosure.
Figure 9:
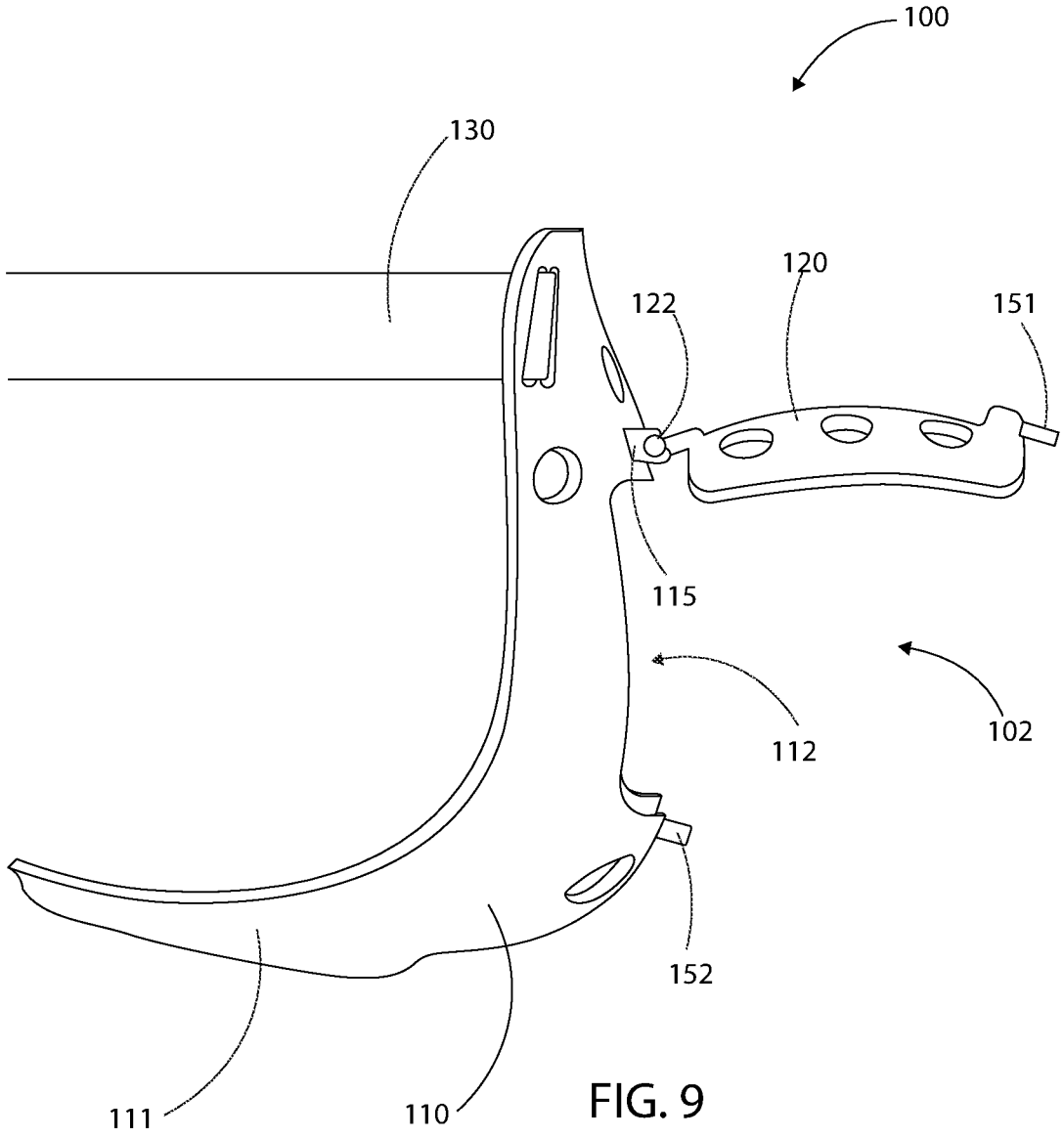
FIG. 9 is a side view of the device in the open position, according to an embodiment of the present disclosure.
Figure 10:
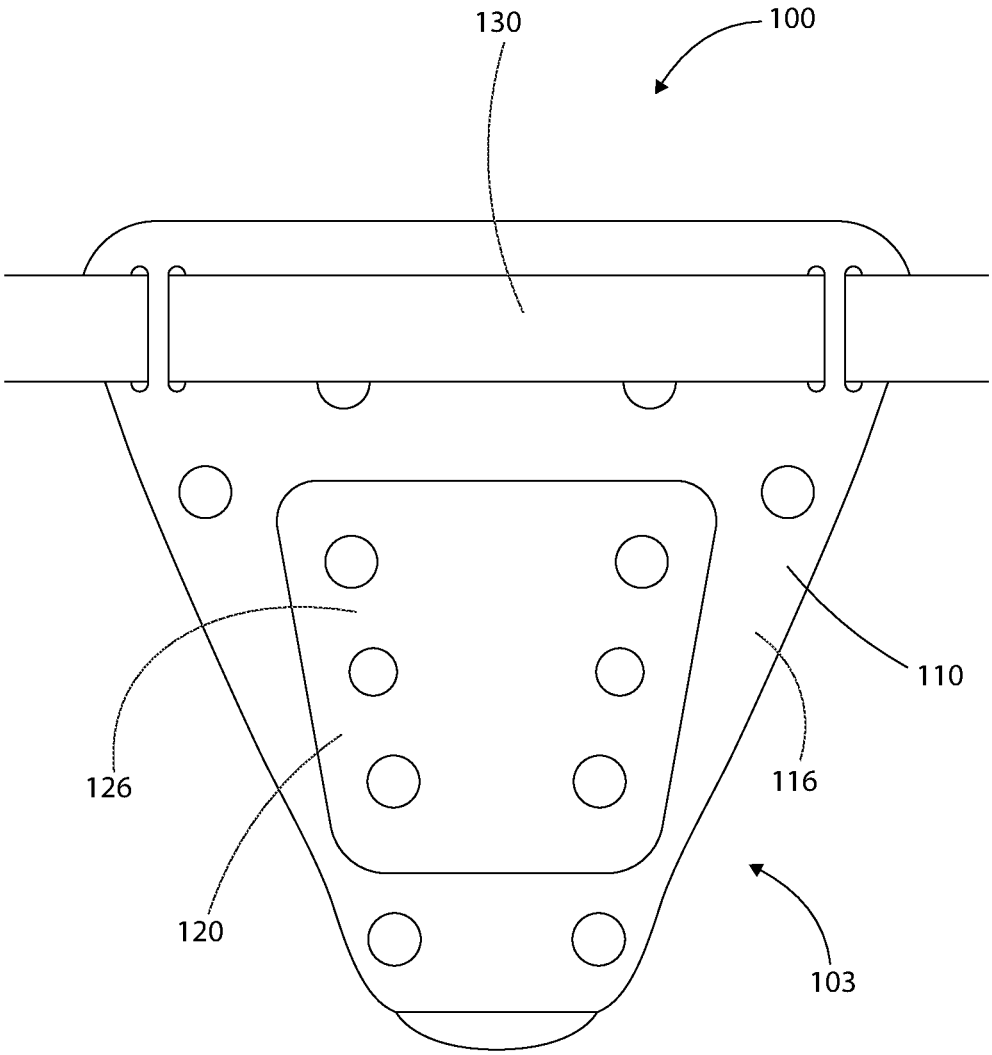
FIG. 10 is a rear view of the device in the closed position, according to an embodiment of the present disclosure.
Figure 11:
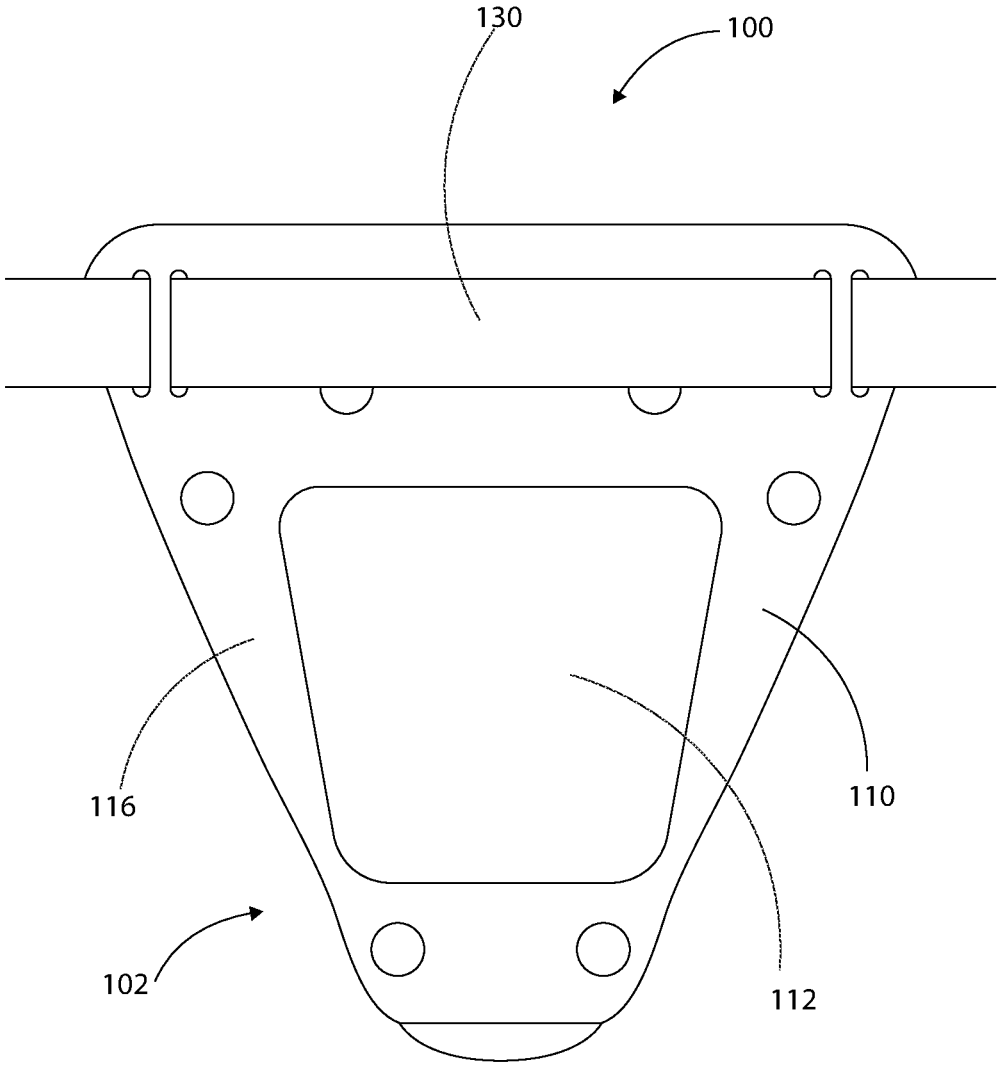
FIG. 11 is a rear view of the device in the open position, according to an embodiment of the present disclosure.
Figure 12:
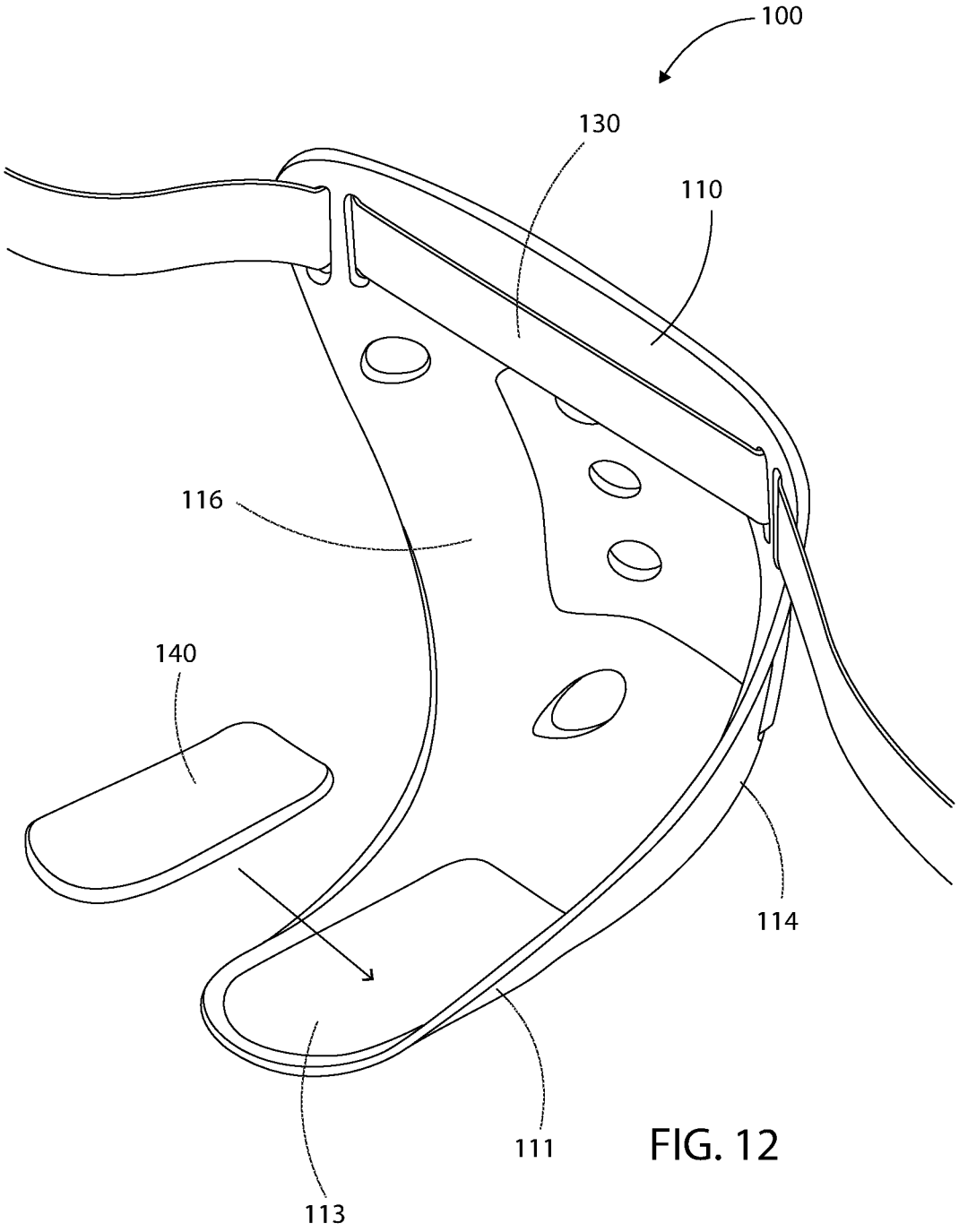
FIG. 12 is a perspective rear view of the device and illustrating the main body having a tail section and a receptacle for receiving at least one temperature therapy pack, according to an embodiment of the present disclosure.

The main body 110 may include an opening 112 (hatch) therein, an outer surface 114, and an inner surface 116. The inner surface 116 may be configured for encompassing the groin area of the user 5. For example, the main body 110 may be shaped as a 'cup' that encompasses the groin area/genital area of the user 5. As such, as shown, the outer surface 114 may be at least partially convex and the inner surface 116 may be at least partially concave to encompass the groin area. Preferably, the main body 110 may be made from a durable rigid material such that the main body 110 is able to absorb impacts thereto and thereby protect the groin area/genital area of the user 5. For example, in some embodiments, the main body 110 may include a plastic material to provide at least some flexibility and a lightweight feel to the device 100. However, it should be appreciated that the main body 110 is not limited to the plastic material. For example, metal, foam, etc. may be used. Further, as shown, the main body 110 may include a first plurality of perforations 119 therein (FIG. 6). The first plurality of perforations 119 may provide ventilation to the groin area of the user 5.

As discussed above, the fastener 130 may be at least one strap 132. In this embodiment, the main body 110 may include a strap receiver means. For example, as shown in FIG. 3, the strap receiver means may include a first receiver element 133 having a first pair of apertures 134 and a second receiver element 135 having a second pair of apertures 136 each configured to threadably receive a portion of the at least one strap 132 therewithin.

As shown in FIGS. 4-9 in particular, the cover 120 may be attached to the main body 110 and configured to selectively cover and uncover the opening 112 (hatch) therein. Preferably, the cover 120 may include a curvature configured to conform to the curvature of the main body 110. For example, the cover 120 may include a second (at least partially concave) inner surface 126 and a second (at least partially convex) outer surface 127. When the cover 120 covers the opening 112, the cover 120 may also be flush to the main body 110. Further, preferably, the cover 120 may comprise the durable rigid material so as to not compromise the protection offered by the device 100. For example, the cover 120 may include the plastic material. In addition to this, the cover 120 may include a second plurality of perforations 124 (FIG. 6) also configured to provide ventilation to the groin area of the user 5.

The cover 120 may selectively move the opening 112 between an open position 102 (as shown in FIG. 2, FIG. 5, FIG. 7, FIG. 9 and FIG. 11) and a closed position 103 (as shown in FIG. 1, FIG. 4, FIG. 6, FIG. 8 and FIG. 10). As shown in FIGS. 1-2, the opening 112 may be located about the genital area of the user 5 when the device 100 is secured to the user 5. As such, when the opening 112 is in the open position 102, the user 5 is able to urinate through the opening 112, thereby enabling the user 5 to relieve themselves without having to remove the device 100. Further, it is also contemplated that the user 5 may be able to defecate without having to remove the device 100. This may be aided by the configuration of the at least one strap 132 and its attachment about the waist area of the user 5, as the user 5 may simply sit down and flip the device 100 up without removing it.

In some embodiments, as shown in FIGS. 3-9 in particular, the cover 120 may be pivotably attached to the main body 110 and therefore may pivot relative to the main body 110 to move the opening 112 between the open position 102 and the closed position 103. For example, as shown, the main body 110 may include at least one hinge bracket 115 and the cover 120 may include a hinge member 122 for engagement with the at least one hinge bracket 115. Particularly, the hinge member 122 may be attached to the second outer surface 127 of the cover 120. The at least one hinge bracket 115 may include a first hinge bracket 1151 and a second hinge bracket 1152. The hinge brackets 1151, 1152 may each include two flexible clips defining a seat therebetween for receiving a portion of the hinge member 122. In some embodiments, the hinge member 122 may be fused to the cover 120, and the at least one hinge bracket 115 may be fused to the main body 110. However, it should be appreciated that the members 122, 115 are not limited to this means of attachment.

In some embodiments, the device 100 may further comprise a means of holding the cover 120 open (and thus the opening 112 in the open position 102) which may allow the user 5 to urinate without having to hold the cover 120. For example, the hinge member 122 may be held sufficiently tight/stiff within the at least one hinge bracket 115 to hold the cover 120 open. It should however be appreciated that other means may be used.

As shown in FIG. 3, the hinge member 122 may be located at a top edge 121 of the cover 120 and the at least one hinge bracket 115 may be located a top periphery edge 117 of the opening 112. Thus, the cover 120 may be lifted from a bottom thereof to uncover 120 the opening 112 (placing the opening 112 in the open position 102). However, it should be appreciated that the hinge member 122 and the at least one hinge bracket 115 are not limited to these locations. For example, the cover 120 may open from the top or from a side (and therefore the hinge member 122 and the at least one hinge bracket 115 attached to the cover 120 and the main body 110 respectively, accordingly). It should also be appreciated that the cover 120 may not be pivotably attached to the main body 110. For example, the cover 120 may be configured to slide relative to the main body 110. It should also be appreciated that the cover 120 may not be pivotably attached to the main body 110 (and therefore the device 100 may not include the hinge member 122 and the hinge bracket 115). For example, the cover 120 may be configured to slide relative to the main body 110.

An attachment mechanism 150 may be provided and configured to selectively secure the cover 120 over the opening 112 so that the cover 120 does not inadvertently open and compromise protection of the groin area. As shown in FIGS. 4-9, preferably, the attachment mechanism 150 may include a latch mechanism 152. For example, the main body 110 may include at least one latch bracket 153 and the cover 120 may include at least one latch protrusion 151 for engagement with the at least one latch bracket 153. Particularly, the at least one latch bracket 153 may again include a flexible clip defining a seat configured to receive and retain the at least one latch protrusion 151. The at least one latch protrusion 151 and the at least one latch bracket 153 may be fused to the cover 120 and the main body 110, respectively. However, the at least one latch protrusion 151 and the at least one latch bracket 153 may not be limited to this form of attachment.

As above, the hinge member 122 may be located at the top edge 121 of the cover 120 and the at least one hinge bracket 115 may be located at the top periphery edge 117 of the opening 112. In this embodiment, the at least one latch protrusion 151 may be located at a bottom edge 123 of the cover 120 and the at least one latch bracket 153 may be located about a bottom periphery edge 118 of the opening 112. However, again, it should be appreciated that the at least one latch protrusion 151 and the at least one latch bracket 153 may not be limited to these locations. It should also be appreciated that the latch mechanism 152 is not limited to the configuration described above. It should also further be appreciated that the attachment mechanism 150 is not limited to the latch mechanism 152. For example, magnets may be used.

As shown in FIGS. 3-5, FIGS. 8-9 and FIG. 12 particularly, the main body 110 may preferably include a tail section 111. The tail section 111 may extend rearwardly (relative to the user 5) from a bottom of the main body 110. Further, as particularly shown in FIG. 12, the tail section 111 may include a receptacle 113. For example, the receptacle 113 may be defined by a depression in the tail section 111. Preferably, the receptacle 113 may be sized to hold at least one temperature therapy pack 140. This may provide temperature therapy to the user 5 which may further aid in healing after injury or operation. For example, the temperature therapy pack 140 may include at least one ice pack. It may also be contemplated that heat packs may be used. In some embodiments, the device 100 may be provided with temperature therapy pack(s) 140. In other embodiments, the device 100 and the temperature therapy pack(s) 140 may be provided separately. Further, in some embodiments, the device 100 may be used with existing ice/heat packs.

It should be appreciated that if desired, the device 100 may be used solely for providing temperature therapy regardless of whether groin protection is needed. For example, in some embodiments, the user 5 may remove the cover 120 if they do not need groin protection, place the temperature therapy pack 140 into the receptacle 113 and use the device 100 to provide temperature therapy to the groin area.

Figure 13:
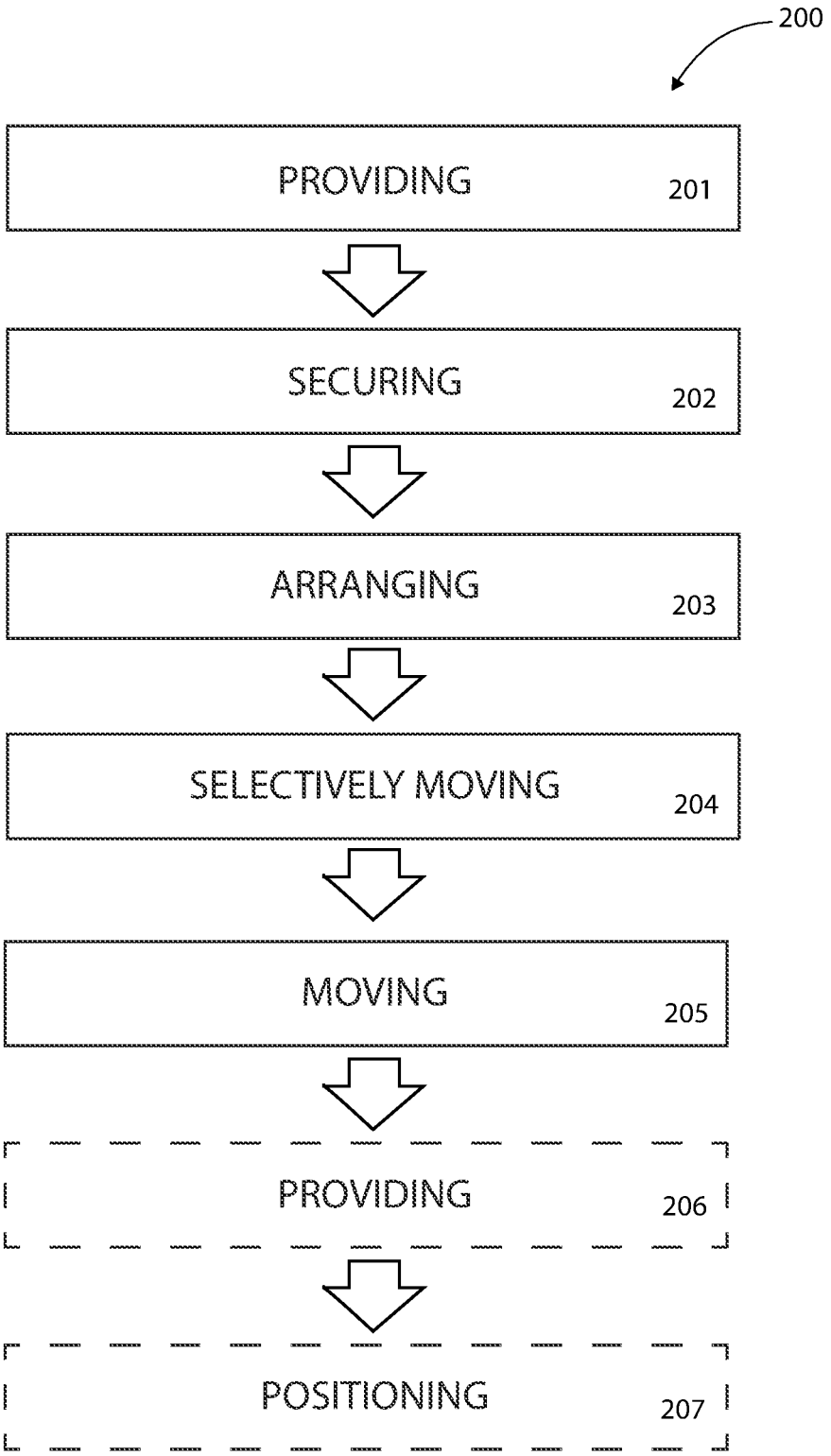
FIG. 13 is a flow diagram illustrating a method of using a device for protecting a groin area of a user, according to an embodiment of the present disclosure.

Referring now to FIG. 13 showing a flow diagram illustrating a method 200 of using a device for protecting a groin area of a user, according to an embodiment of the present disclosure. In particular, the method 200 may include one or more components or features of the device 100 as described above. As illustrated, the method 200 may include the steps of: step one 201, providing the device as above; step two 202, securing the device to the user via the fastener; step three 203, arranging the main body such that the inner surface encompasses the groin area of the user; step four 204, selectively moving the cover to uncover the opening, thereby placing the opening in the open position and enabling the user to urinate therethrough; and step five 205, moving the cover to cover the opening, thereby placing the opening in the closed position. Further steps may include step six 206, providing the device as above (including the tail section having the receptacle sized to hold at least one temperature therapy pack); and step seven 207, positioning the at least one temperature therapy pack within the receptacle.

It should be noted that certain steps are optional steps and may not be implemented in all cases. Optional steps of method 200 are illustrated using dotted lines in FIG. 13 so as to distinguish them from the other steps of method 200. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for protecting a groin of a user and for providing a bodily fluid relief means are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A device for protecting a groin area of a user, the device comprising:

a main body including an opening therein, an outer surface and an inner surface, the inner surface configured for encompassing the groin area of the user, the main body includes a tail section extending rearwardly from a bottom thereof, the tail section includes a receptacle, the receptacle being is sized to hold at least one temperature therapy pack;

a cover attached to the main body and configured to selectively cover and uncover the opening, thereby moving the opening between an open position and a closed position;

a fastener attached to the main body and configured to secure the device to the user; and wherein the opening is located about a genital area of the user when the device is secured to the user, and wherein the open position enables the user to urinate through the opening.

2. The device of claim 1, wherein the outer surface is at least partially convex, and wherein the inner surface is at least partially concave.

3. The device of claim 2, wherein the cover is pivotably attached to the main body, wherein the main body includes at least one hinge bracket, and wherein the cover includes a hinge member for engagement with at least one hinge bracket.

4. The device of claim 3, wherein the hinge member is located at a top edge of the cover, and wherein the at least one hinge bracket is located about a top periphery edge of the opening.

5. The device of claim 1, further comprising an attachment mechanism configured to selectively secure the cover over the opening.

6. The device of claim 5, wherein the attachment mechanism includes a latch mechanism, wherein the main body includes at least one latch bracket, and wherein the cover includes at least one latch protrusion configured for engagement with the at least one latch bracket.

7. The device of claim 6, wherein the at least one latch protrusion is located at a bottom edge of the cover, and wherein the at least one latch bracket is located about a bottom periphery edge of the opening.

8. The device of claim 7, wherein the fastener includes at least one strap, and wherein the at least one strap is configured to fasten around a waist area of the user.

9. The device of claim 8, wherein the main body comprises a plastic material.

10. The device of claim 9, wherein the cover comprises the plastic material.

11. A device for protecting a groin area of a user, the device comprising:

a main body including an opening therein, an at least partially convex outer surface, an at least partially concave inner surface, a tail section, and at least one hinge bracket, the at least partially concave inner surface configured for encompassing the groin area of the user, the tail section including a receptacle sized to hold at least one temperature therapy pack;

a cover pivotably attached to the main body and configured to selectively cover and uncover the opening, thereby moving the opening between an open position and a closed position, the cover including a hinge member configured for engagement with the at least one hinge bracket;

at least one strap attached to the main body, the at least one strap configured to fasten around a waist area of the user to secure the device to the user; and wherein the opening is located about a genital area of the user when the device is secured to the user, and wherein the open position enables the user to urinate through the opening.

12. The device of claim 11, wherein the hinge member is located at a top edge of the cover, and wherein the at least one hinge bracket is located about a top periphery edge of the opening.

13. The device of claim 11, further comprising an attachment mechanism configured to selectively secure the cover over the opening.

14. The device of claim 13, wherein the attachment mechanism includes a latch mechanism, wherein the main body includes at least one latch bracket, wherein the cover includes at least one latch protrusion configured for engagement with the at least one latch bracket, wherein the at least one latch protrusion is located at a bottom edge of the cover, and wherein the at least one latch bracket is located about a bottom periphery edge of the opening.

15. The device of claim 11, wherein the main body comprises a plastic material, and wherein the cover comprises the plastic material.

16. A method of using a device for protecting a groin area of a user, the method comprising the steps of:

providing the device including:

a main body including an opening therein, an outer surface, and an inner surface, the inner surface configured for encompassing the groin area of the user, the main body includes a tail section extending rearwardly therefrom relative to the user, the tail section includes a receptacle, the receptacle being is sized to hold at least one temperature therapy pack; and positioning at least one temperature therapy pack within the receptacle;

a cover attached to the main body and configured to selectively cover and uncover the opening, thereby moving the opening between an open position and a closed position;

a fastener attached to the main body and configured to secure the device to the user; and wherein the opening is located about a genital area of the user when the device is secured to the user, and wherein the open position enables the user to urinate through the opening;

securing the device to the user via the fastener;

arranging the main body such that the inner surface encompasses the groin area of the user;

selectively moving the cover to uncover the opening, thereby placing the opening in the open position and enabling the user to urinate therethrough; and moving the cover to cover the opening, thereby placing the opening in the closed position.

* * * * *